US010401103B2

(12) United States Patent
Konev et al.

(10) Patent No.: US 10,401,103 B2
(45) Date of Patent: Sep. 3, 2019

(54) FIREARM WITH GAS BLOCK ATTACHED TO UPPER RECEIVER

(71) Applicants: Konstantin J Konev, Denver, TX (US); Jurij Konev, Minsk (BY)

(72) Inventors: Konstantin J Konev, Denver, TX (US); Jurij Konev, Minsk (BY)

( * ) Notice: Subject to any disclaimer, the term of this patent is extended or adjusted under 35 U.S.C. 154(b) by 0 days.

(21) Appl. No.: 15/864,317

(22) Filed: Jan. 8, 2018

(65) Prior Publication Data

US 2019/0212083 A1 Jul. 11, 2019

(51) Int. Cl.
*F41A 5/28* (2006.01)
*F41C 27/22* (2006.01)
*F41A 3/66* (2006.01)

(52) U.S. Cl.
CPC ..... *F41A 5/28* (2013.01); *F41A 3/66* (2013.01); *F41C 27/22* (2013.01)

(58) Field of Classification Search
CPC ..... F41A 5/18; F41A 5/20; F41A 5/22; F41A 5/24; F41A 5/26; F41A 5/28; F41A 3/66; F41C 27/22
USPC ..... 89/191.01–193; 42/71.01, 72
See application file for complete search history.

(56) References Cited

U.S. PATENT DOCUMENTS 2,775,166 A * 12/1956 Janson ..... F41A 3/40 42/16
3,198,076 A * 8/1965 Stoner ..... F41A 3/26 42/75.02
4,358,986 A * 11/1982 Giorgio ..... F41A 3/26 89/1.4
4,553,469 A * 11/1985 Atchisson ..... F41A 3/46 42/25
4,930,399 A * 6/1990 Trevor, Jr. ..... F41A 3/46 89/185
5,123,194 A * 6/1992 Mason ..... F41A 3/86 42/75.02
5,198,600 A * 3/1993 E'Nama ..... F41C 27/00 42/105
5,247,758 A * 9/1993 Mason ..... F41A 3/86 42/75.02
7,810,271 B2 * 10/2010 Patel ..... F41A 11/02 42/75.03

(Continued)

OTHER PUBLICATIONS

Konev, Konstantin, "Konev Fire Arms Advanced Firearms Development", Copyright 2000, Konev Firearms, <https://www.konevfirearms.com/>, All Pages. (Year: 2000).*

*Primary Examiner* — Jonathan C Weber

(57) ABSTRACT

The present invention relates to firearms and, more particularly, to automatic or semiautomatic firearms. In a first embodiment, the gas block of the firearm is tightly bound with the upper receiver rather than the barrel, and the receiver serves as a dampening element for gas block vibrations during shooting such that the impact on the barrel is significantly reduced. Fasteners and barrel nuts are used to rigidly position the gas block relative to the upper receiver to best reduce the impact on the barrel. In another embodiment the gas block is attached both to the upper receiver and to the barrel using a support element. Such fixation of the gas block prevents rotation of the firearm and further decreases vibrations of the barrel. In yet another embodiment, the firearm fits interchangeable magazine wells to change the caliber of the firearm.

14 Claims, 6 Drawing Sheets

(56) References Cited

U.S. PATENT DOCUMENTS 8,210,089 B2 * 7/2012 Brown ..... F41A 5/18 89/191.02
8,468,929 B2 * 6/2013 Larson ..... F41A 5/28 89/191.01
9,010,233 B2 * 4/2015 St. George ..... F41A 5/20 42/69.02
9,032,860 B2 * 5/2015 Faxon ..... F41A 15/14 89/193
9,134,082 B2 * 9/2015 Brown ..... F41A 5/18
9,377,257 B2 * 6/2016 Foster ..... F41A 3/72
2004/0211105 A1 * 10/2004 Arachequesne ..... F41G 1/02 42/113
2005/0115398 A1 * 6/2005 Olson ..... F41A 21/00 89/193
2006/0026883 A1 * 2/2006 Hochstrate ..... F41C 23/16 42/75.01
2010/0229445 A1 * 9/2010 Patel ..... F41A 3/66 42/6
2010/0269682 A1 * 10/2010 Vuksanovich ..... F41A 3/26 89/191.01
2011/0179945 A1 * 7/2011 Clark ..... F41A 5/18 89/193
2011/0271827 A1 * 11/2011 Larson ..... F41A 5/28 89/193
2012/0198990 A1 * 8/2012 Brittin ..... F41A 5/26 89/191.01
2013/0068089 A1 * 3/2013 Brown ..... F41A 5/18 89/193
2013/0283663 A1 * 10/2013 Joplin ..... F41G 11/003 42/124
2014/0224114 A1 * 8/2014 Faxon ..... F41A 15/14 89/193
2014/0331853 A1 * 11/2014 St. George ..... F41A 5/20 89/191.02

* cited by examiner

FIREARM WITH GAS BLOCK ATTACHED TO UPPER RECEIVER

FIELD OF THE INVENTION

The present invention relates to firearms and, more particularly, to automatic or semiautomatic firearms.

BACKGROUND

There are conventional gas-operated firearms with a gas block mounted on the barrel. In the conventional gas block a portion of high-pressure gas is pushing an operation rod, and the gas block is experiencing a reaction in the opposite direction. As a result, the movement of the gas block is affecting the barrel. This leads to vibrations of the barrel and the reduction of aiming accuracy. See FIG. 1, where the barrel is 3, the gas block is 2 and the operation rod is 15. An impact of the shooting is causing gas pulses going into the gas block. Since the firing of the bullets occurs in rapid succession at a rate of hundreds of bullets per minute, the barrel is shaking, and thus the accuracy of aiming is dramatically affected. It would be beneficial to reduce the barrel vibrations and rotations.

A few prior patent applications, US 2014/0224114 and US 2011/0271827, address a connection between the gas block and upper receiver but only via a rail on which the gas block can slide. The gas block does not have any rigid fixation to the receiver, there is still a gap between the receiver and the gas block, and the gas pulse impact is not neutralized by the receiver. The receiver does not use its mass (combined with the mass of the shooter or the support of the firearm) to neutralize the impact.

At present, the idea of modular weapons has become popular. By replacing the barrel, bolt and magazine, one can change the caliber of the used magazines. Often, magazines of different calibers have a different design. This requires the use of various magazine wells. A lower receiver is typically mounted to the upper receiver using pins. U.S. Pat. No. 7,810,271 discloses a similar idea: its trigger house is connected to the magazine well and to the upper receiver using pins and apertures. In practice, the existing gaps and gradual wear lead to loosening of this joint and disruption of the mechanisms. A new solution is also required to solve this problem.

SUMMARY OF THE INVENTION

The firearm of the present invention comprises a monolithic upper receiver (receiver with handguard). The gas block is tightly bound (for example, by fasteners 17*a* and 17*b*, or 10 and 11) with the upper receiver, and the upper receiver serves as a dampening element for the gas block vibrations during shooting.

Furthermore, it is beneficial to attach the gas block and the barrel. In some embodiments, the gas block is attached in a manner which allows movement of the barrel relative to the gas block. Such relative movement allows for vibrations of the gas block to have less impact on the barrel and also for thermal expansion to occur without causing a curvature in either the gas block or the barrel due to their rigid fixation. The present invention also discloses an optional support element, which provides an additional connection between the gas block, the upper receiver, and the barrel, while also allowing the barrel to slide within the support element. This fixation of the gas block prevents rotation of the firearm and further decreases vibrations of the barrel.

The upper receiver has a long rail on its underside, which is inserted into a magazine well and a trigger house. The position of the installed magazine well and trigger house is fixed by means of pins, screws, or other fasteners.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
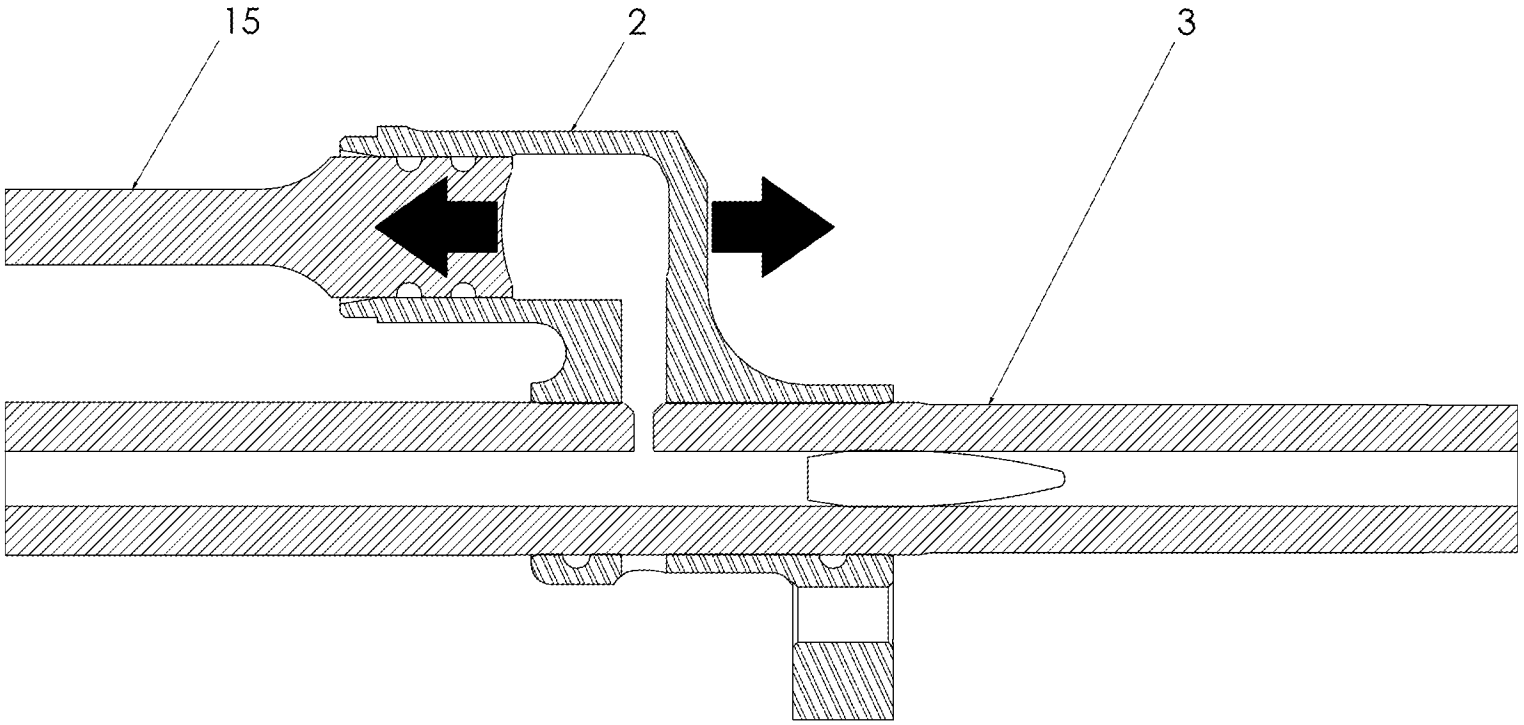
FIG. 1 (Prior art) shows the position of the gas block relative to the barrel in a standard configuration.
Figure 2:
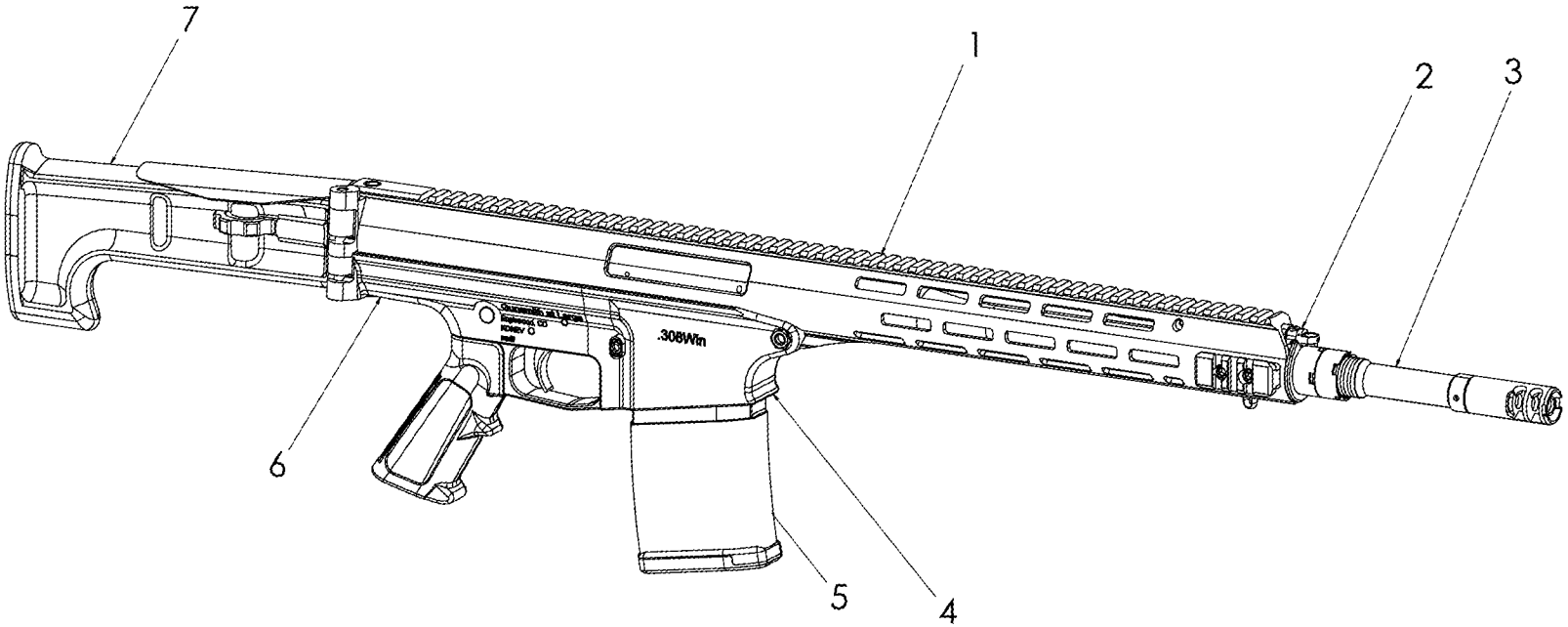
FIG. 2 is an isometric view of the automatic firearm incorporating features in accordance with an exemplary embodiment.

Referring to FIG. 2, there is shown an isometric view of the automatic firearm capable of automatic or semiautomatic fire incorporating features in accordance with an exemplary embodiment of the present invention.

Although the present invention will be described with reference to the embodiments shown in the drawings, it should be understood that the present invention can be embodied in many alternate forms. In addition, any suitable size, shape or type of elements or materials could be used.

The firearm and its sections described in greater detail below are merely exemplary, and in alternate embodiments the firearm may have other sections, portions, or systems. It is further noted that the use of pins may equally imply the use of screws, nuts, bolts, welding elements, or any other type of fastening elements (i.e., fasteners) known in the art.

The firearm comprises the upper receiver 1, the barrel 3, and a gas block 2. The firearm optionally further incorporates the stock 7, the lower receiver 6, the magazine well 4, and the clip or the magazine 5. As will be described below, the upper receiver 1, the barrel 3, the lower receiver 6 and the magazine well 4 are separate modules and are configurable such that the firearm comprises a modular rifle design. In addition, the lower receiver 6 and the magazine well 4 are optionally removable with tools and fasteners. As an example, the magazine well 4*a* may be removed and replaced with another magazine well 4*b* to change caliber. Additionally, modularity with interlocking components is provided for ease of assembly and disassembly without affecting fire accuracy as well as to provide a single reconfigurable firearm without the necessity to have multiple firearms.

Figure 3:
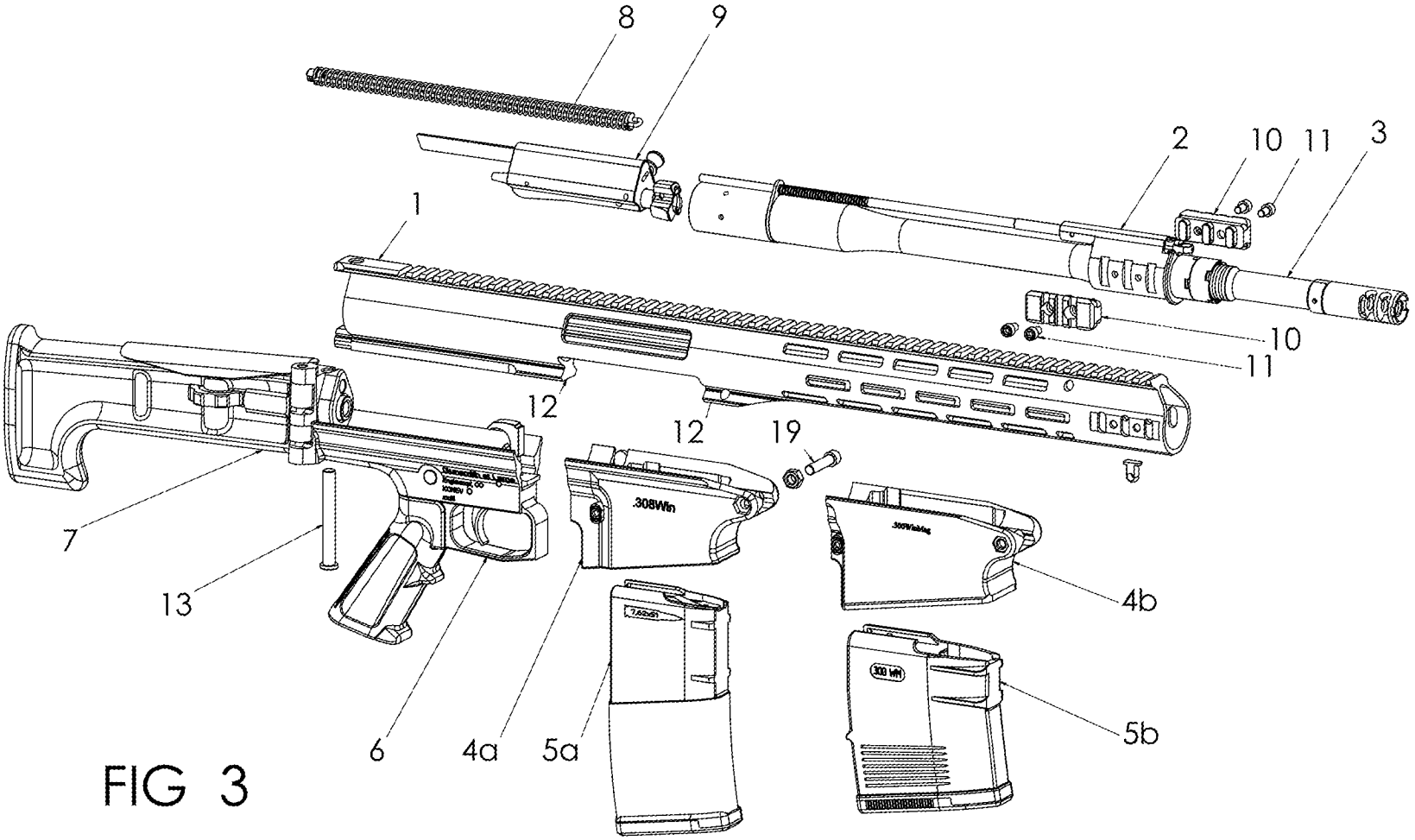
FIG. 3 is an isometric view of the disassembled firearm with a modular lower system.

FIG. 3 shows an isometric view of the disassembled firearm with the upper receiver section 1, the barrel assembly 3 with the gas block 2, the bolt carrier group 9, the main spring 8, the lower receiver 6, the stock 7, the magazine wells 4*a* and 4*b* for different magazines 5*a* and 5*b*. The lower receiver section 6 and the interchangeable magazine wells 4*a* and 4*b* are mounted on the bottom rail 12 of the upper receiver section 1. The lower receiver 6 is fixed with one or more screws, pins, or other fasteners 13 for improved stability. The interchangeable magazine wells 4*a* and 4*b* are also fixed with one or more screws, pins, or other fasteners 19.

Figure 4:
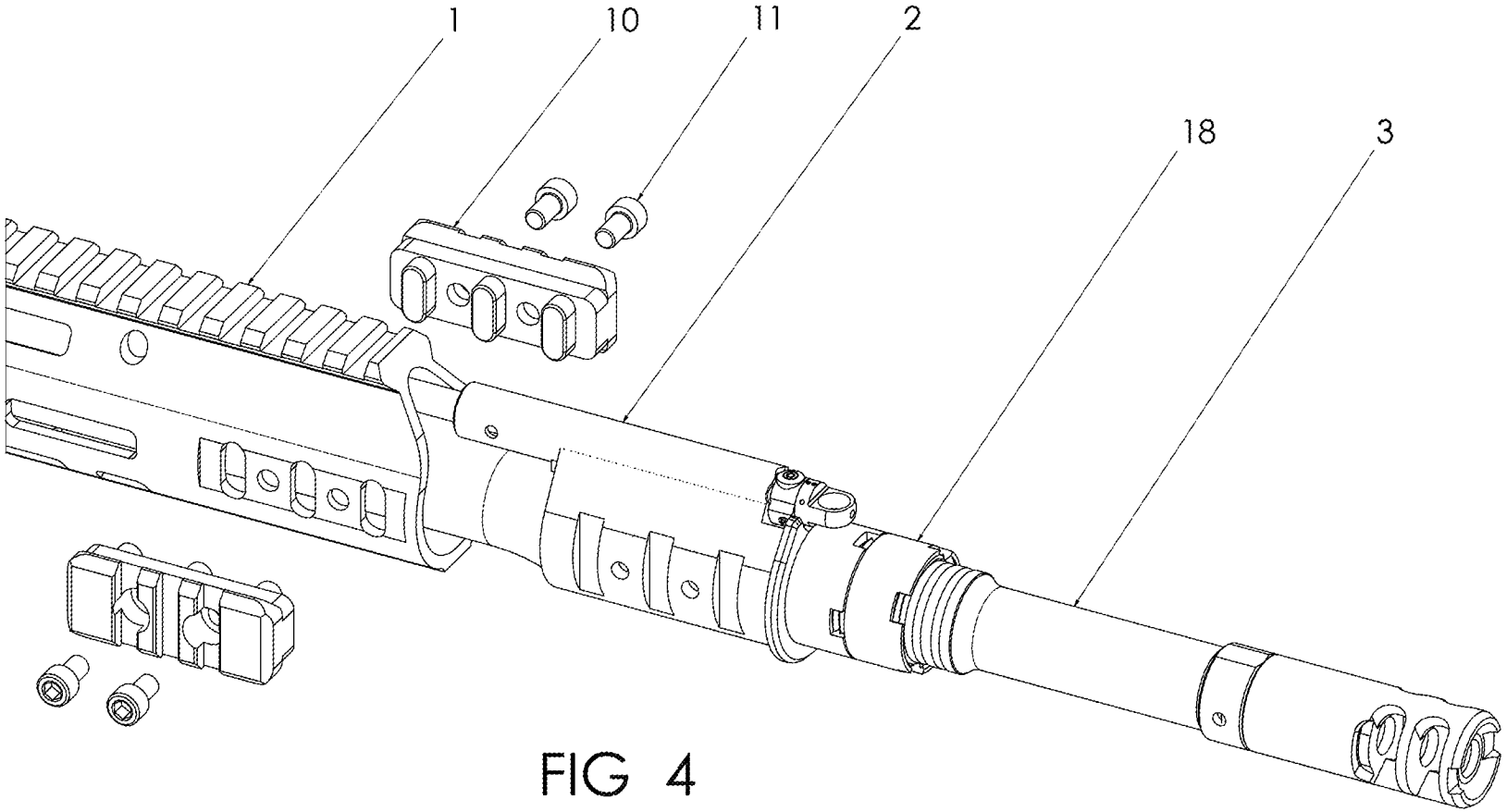
FIG. 4 is an isometric view of the disassembled gas system with the barrel.

FIG. 4 shows an isometric view of the disassembled view of the automatic firearm shown in FIG. 2. The firearm comprises the monolithic upper receiver 1, the barrel 3, the gas block 2, and optional fixing clamps 10 and screws, pins, or other fasteners 11. The gas block 2 is mounted on the barrel 3 via one or more barrel nuts 18. This entire configuration (i.e., the gas block, barrel, and one or more barrel nuts) is inserted inside the upper receiver 1 and fixed by screws 11 (or any fasteners) and optional fixing clamps 10. In this embodiment, the gas block is connected to the barrel and the upper receiver directly, wherein the connection to the upper receiver provides for a reduction of barrel vibration. The connection to the upper receiver creates a neutralizing effect on the gas block and thus the impact on the barrel is also dampened. Furthermore, the effect of thermal expansion is neutralized because the back end of the barrel, which is located inside the upper receiver, is not fixed and thus free to expand due to any rise in temperature. This is shown in FIG. 3, for example, which shows the fixing elements 10, 11 positioned at the front of the upper receiver 1, and no additional fixing elements behind that point of the barrel 3. Thus, in this embodiment, the gas block 2 is required to be rigidly fixed to the upper receiver 1 and to the barrel 3 at the position shown by fixing elements 10 and 11, the result being a significant reduction in barrel vibration.

Figure 5:
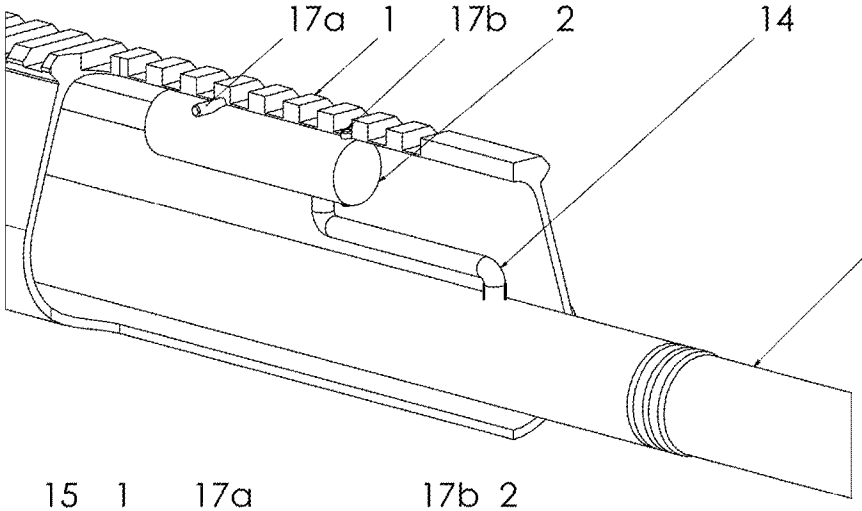
FIG. 5 is an isometric view of the disassembled gas system with the gas camera mounted in the receiver and a gas tube.

FIG. 5 shows another embodiment of the present invention wherein the gas block 2 is mounted to the upper receiver section 1. In this example, the gas block 2 is mounted via fixing elements 17*a* and 17*b*, but it is noted that any fixing element known in the art may be used to mount the gas block 2 along the upper receiver 1 as shown. The gases are transferred from the barrel 3 via the gas tube 14. The gas tube 14 is flexible such that the upper receiver 1 and gas block 2 can move relative to the barrel 3, e.g., to adjust for any thermal expansion or additional movement of the gas block 2. Typically, in prior art embodiments, the gas block is touching a significant portion of (i.e., connecting along its length to) the barrel, and this causes additional instability of the barrel when the gas block moves. It is important to create less connection if possible between the gas block and the barrel to reduce vibration while using the firearm. The gas block 2 of the present invention is thus connected to the upper receiver section 1 rather than the barrel. Additionally, the gas block 2 is connected to the barrel by a flexible gas tube 14.

Figure 6:
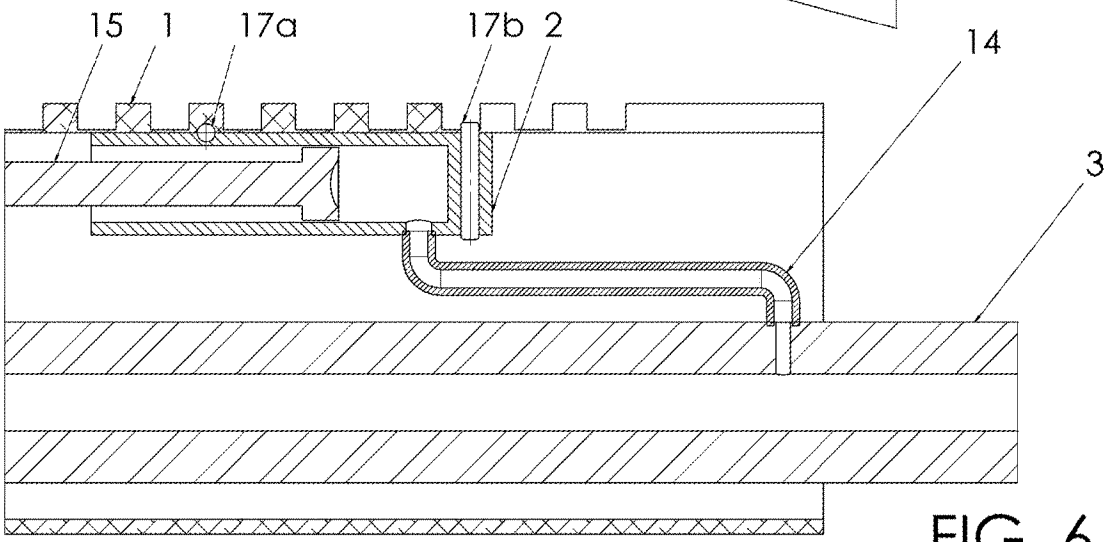
FIG. 6 is a cross sectional view of the system shown in FIG. 6.

The firearm of the present invention comprises an monolithic upper receiver with a gas block. The gas block is tightly bound, or rigidly fixed, with the upper receiver, and the receiver serves as a dampening element for vibrations affecting the gas block during shooting. Means for fixing a position of the gas block, such as pins 17*a* and 17*b*, are inserted in their respective positions, as shown in FIGS. 5-6. One pin is inserted along a first axis (e.g., horizontally) and a corresponding pin is inserted along a second axis (e.g., vertically), such that the pins fix the gas block in a position. The gas block remains rigidly fixed in this position so it cannot rotate along either axis due to vibrations of the firearm during shooting. In fact, the gas block is fixed such that it cannot move in any of the three orthogonal directions (X, Y, Z) due to the combination of pins inserted. It should be noted that the above is only one example of the direction of axes of pins that may be inserted. For example, two pins inserted at opposite 45-degree angles (i.e., opposite diagonals) would also maintain the same fixation of the gas block. Any rendition or combination of two or more pins is possible, so long as the gas block is fixed in all three orthogonal directions.

FIG. 6 shows a cross-sectional view of the firearm shown in FIG. 5, wherein the gas block 2 is mounted on the upper receiver section 1. The gases are transferred to the barrel 3 via the flexible gas tube 14. The pins 17*a* and 17*b* are also shown as they would be inserted.

Furthermore, it is beneficial to attach the gas block and the barrel. The present invention also discloses another embodiment of the firearm comprising a support element, which provides an additional connection between the gas block, the upper receiver, and the barrel. This fixation of the gas block due to the support element prevents rotation of the firearm and further decreases vibrations of the barrel during shooting.

Figure 7:
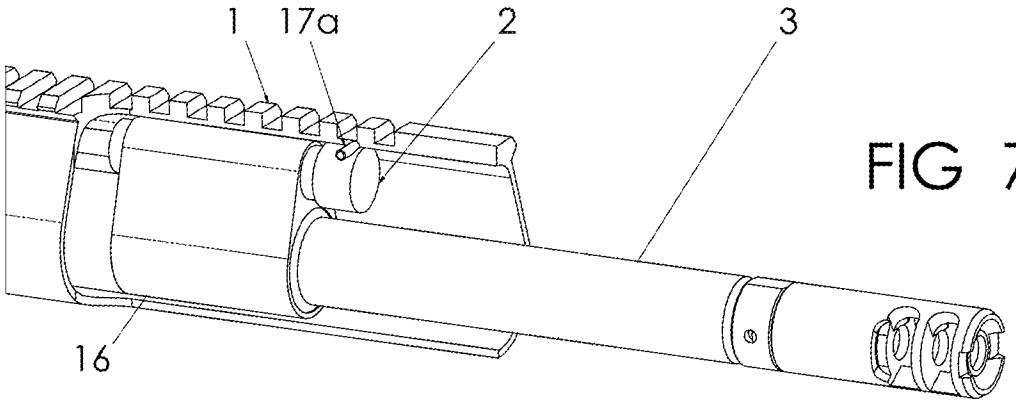
FIG. 7 is an isometric view of the disassembled gas system with a gas camera mounted in the receiver and a slide contact with the barrel elements.

FIG. 7 shows an exemplary embodiment of the present invention wherein the gas block 2 is mounted on the upper receiver section 1, further comprising a support element 16 which is mounted on (i.e. surrounds) the barrel 3 as well as the gas block 2. The support element has two through holes—one for the gas block 2 and another one for the barrel 3. In a preferred embodiment, both of these through holes are round holes corresponding to the diameter of the gas block and the barrel accordingly. In some cases, the through hole for the barrel is slightly larger than the diameter of the barrel 3, and/or contains a sliding material such that the barrel may move along the through hole relative to the gas block 2, so that a movement of one element (i.e., either the gas block 2 or the barrel 3) does not impact the other.

Figure 8:
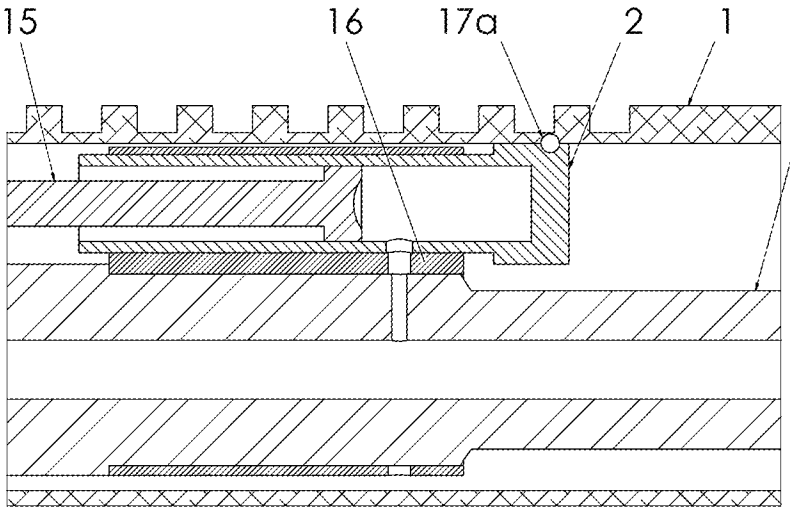
FIG. 8 is a cross sectional view of the system shown in FIG. 7.

FIG. 8 shows a cross-sectional view of the same firearm as that in FIG. 7, wherein the gas block 2 is mounted on the upper receiver section 1, and wherein the support element 16 is mounted on the barrel 3 and the gas block 2. There is also a pin 17*a* optionally located in this embodiment, which prevent movement of the gas block relative to the upper receiver along a first axis.

Embodiments of the present invention may be summarized as follows:

The present invention comprises an automatic or semi-automatic firearm, comprising:

an upper receiver, a barrel, and a gas block mounted to said upper receiver, said gas block being mounted to said upper receiver by a first means for fixing said gas block's position relative to said upper receiver such that the receiver may act to neutralize the impact of any movement of the gas block and so that the gas block is not necessarily mounted to the barrel. Furthermore, an internal volume of said gas block is connected to an internal volume of said barrel so that gases within the barrel may be removed via the gas block. The gas block is rigidly fixed to said upper receiver such that said upper receiver reduces a movement of said gas block thus reducing an impact from said gas block towards said barrel.

In some aspects, the gas block is connected to the barrel via a gas tube. In some aspects, this tube is flexible so as to allow for thermal expansion without causing a movement of the barrel to affect the position of the gas block or upper receiver.

In some aspects, the first means for mounting the gas block to the upper receiver comprise one or more pins. In some aspects, the first means comprise one or more barrel nuts. When barrel nuts comprise the first means, the pins may not be necessary. Barrel nuts allow for a dynamic connection to occur between the gas block, upper receiver, and the barrel, as described herein.

In some aspects, the firearm further comprises one or more fasteners inserted on either side of the upper receiver (i.e., left side, right side), said one or more fasteners mounting both the barrel and the gas block via holes in or connected to the one or more barrel nuts. This is best shown in FIG. 4, where the barrel is shown in a position prior to insertion into the upper receiver. The fastening elements 11 line up with the holes in the upper receiver as well as the holes near the barrel nuts (once the barrel is fully inserted into the upper receiver).

In some aspects, the firearm further comprises one or more fixing clamps 10 positioned between the upper receiver and the fasteners. For example, one fixing clamp may be positioned on the right side, and another fixing clamp may be positioned on the left side of the upper receiver.

In some aspects, the barrel is mounted to said upper receiver, said barrel being mounted by a second means for fixing said barrel's position relative to said upper receiver. For example, a first means for mounting the gas block to the upper receiver may comprise one or more pins, a second means for fixing the barrel to the upper receiver may comprise one or more fasteners, and the gas block may be further mounted to said barrel (e.g., via one or more barrel nuts).

In some aspects, the firearm may comprise a support element for fixing the gas block relative to the barrel. In some aspects, the support element surrounds both the barrel and the gas block so that the barrel and gas block are at least somewhat fixed relative to each other. In some aspects, the support element is coupled with the first means for fixing the gas block relative to the upper receiver comprises one fastener inserted horizontally, said one fastener passing through the upper receiver and the gas block.

In some aspects, the firearm comprises first means for fixing the gas block comprising two pins, wherein a first pin is inserted along a first axis and a second pin is inserted along a second axis, said second axis being perpendicular to said first axis, wherein both pins pass through both the upper receiver and the gas block, such that the combination of axes of pins inserted prevents movement of the gas block in all three orthogonal directions X, Y, and Z. For example, the first pin is inserted horizontally and the second pin is inserted vertically. Any configuration wherein the two or more pins are perpendicular to each other is possible.

In some aspects, the first means and the second means for fixing within the firearm are interconnected, wherein the first means is a part of the second means. For example, when fasteners are employed to connect the upper receiver to the holes in or near the barrel nuts, the means for connecting the barrel to the gas block (i.e., the barrel nuts) are interconnected and a part of the means for connecting the upper receiver to the gas block (i.e., the fasteners via the holes in the barrel nuts). In this case, the upper receiver and the barrel also become connected as a result.

In some aspects, the firearm further comprises a rail on the bottom part of the upper receiver, the rail being used to support a first magazine well and a trigger house. The magazine well and trigger house may slide along the rail and may be fixed in place by additional fastening elements. In some aspects, the first magazine well is interchangeable with a second magazine well to change the caliber of the firearm. The magazine wells correspond to varying size and caliber magazines, which also may be interchangeable. The magazine well is fixed by one or more particular fasteners and the trigger house is fixed by another particular fastener near the back of the firearm; both types of fasteners provide further stability for aiming the firearm.

In some aspects, the firearm further comprises a bolt carrier group, a main spring, a lower receiver, and a stock. All of these additional elements are connected and engaged in any manner known in the art.

In some aspects, the upper receiver is a monolithic upper receiver.

In some aspects, the gas tube is flexible. Such flexibility allows for the barrel to receive less impact from a movement of the gas tube, and vice versa.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A firearm, comprising:

a lower receiver;

an upper receiver coupled to the lower receiver;

a gas block rigidly coupled directly to the upper receiver via one or more upper receiver fasteners; and a barrel rigidly coupled directly to the gas block via one or more barrel fasteners.

2. The firearm of claim 1, wherein the barrel comprises a discharge end whereby a bullet travels toward the discharge end during operation, and wherein the one or more barrel fasteners are located closer to the discharge end than the one or more upper receiver fasteners.

3. The firearm of claim 1, wherein the barrel comprises a discharge end whereby a bullet travels toward the discharge end during operation, wherein the barrel is rigidly coupled to the gas block at a first location, and the gas block is rigidly coupled to the upper receiver at a second location, and wherein the first location is located closer to the discharge end than the second location.

4. The firearm of claim 1, wherein the one or more upper receiver fasteners are selected from a group consisting of one or more fixing clamps, one or more pins, one or more screws, and one or more welding elements.

5. The firearm of claim 1, wherein the one or more barrel fasteners are selected from a group consisting of one or more fixing clamps, one or more pins, one or more screws, and one or more welding elements.

6. The firearm of claim 1, wherein the one or more upper receiver fasteners protrude through an opening in the upper receiver and into one or more holes in the gas block.

7. The firearm of claim 1, further comprising a rail located on a bottom part of the upper receiver, the rail being configured to support a first magazine well and a trigger house.

8. The firearm of claim 7, further comprising a first magazine well coupled to the rail, wherein the first magazine well is interchangeable with a second magazine well to change a caliber of the firearm.

9. The firearm of claim 8, wherein the first magazine well is fixed by one or more magazine well fasteners.

10. The firearm of claim 9, wherein the one or more magazine well fasteners are selected from a group consisting of one or more fixing clamps, one or more pins, one or more screws, and one or more welding elements.

11. The firearm of claim 7, wherein the rail is further configured to support the lower receiver, and wherein the lower receiver is coupled to the upper receiver via the rail.

12. The firearm of claim 1, wherein the upper receiver is a monolithic upper receiver.

13. The firearm of claim 1, further comprising a support element coupled to the barrel and the gas block.

14. The firearm of claim 13, wherein the support element at least partially surrounds the barrel and the gas block.

* * * * *